United States Patent [19]

Weitzel

[11] 4,155,330

[45] May 22, 1979

[54] ELECTROGRAPHIC DEVELOPMENT APPARATUS FOR USE WITH CONDUCTIVE TONER

[75] Inventor: Richard A. Weitzel, Hilton, N.Y.

[73] Assignee: Eastman Kodak Company, Rochester, N.Y.

[21] Appl. No.: 818,639

[22] Filed: Jul. 25, 1977

[51] Int. Cl.[2] ..... G03G 15/06

[52] U.S. Cl. ..... 118/661; 118/651

[58] Field of Search ..... 118/661, 651, 647, 649, 118/658; 96/1 SD

[56] References Cited

U.S. PATENT DOCUMENTS

| | | | |
|---|---|---|---|
| 2,892,709 | 6/1959 | Mayer | 118/661 X |
| 2,913,353 | 11/1959 | Mayer et al. | 118/661 X |
| 3,405,682 | 10/1968 | King et al. | 118/649 X |
| 3,699,920 | 10/1972 | Von Grabe | 118/661 |
| 3,707,389 | 12/1972 | Maksymiak et al. | 118/647 |
| 3,783,818 | 1/1974 | Makino et al. | 118/647 X |
| 3,816,840 | 6/1974 | Kotz | 118/657 |
| 3,850,662 | 11/1974 | Jahn | 118/647 X |
| 3,866,572 | 2/1975 | Gundlach | 118/661 X |
| 3,952,700 | 4/1976 | Little, Jr. et al. | 118/661 X |
| 4,036,175 | 7/1977 | Phillips et al. | 118/651 |
| 4,050,804 | 9/1977 | Silverberg | 118/661 X |

*Primary Examiner*—Werner H. Schroeder
*Assistant Examiner*—Andrew M. Falik
*Attorney, Agent, or Firm*—John D. Husser

[57] ABSTRACT

A development roller comprising an electrically-conductive core and an electrically-insulative surface layer is biased to retain a monolayer of conductive toner on the surface, and moved into transfer relation with an electrostatic image bearing member to develop the image. The potential level of the toner can be controlled in conjunction with the roller bias to eliminate background or effect image reversal development.

3 Claims, 3 Drawing Figures

FIG. 1
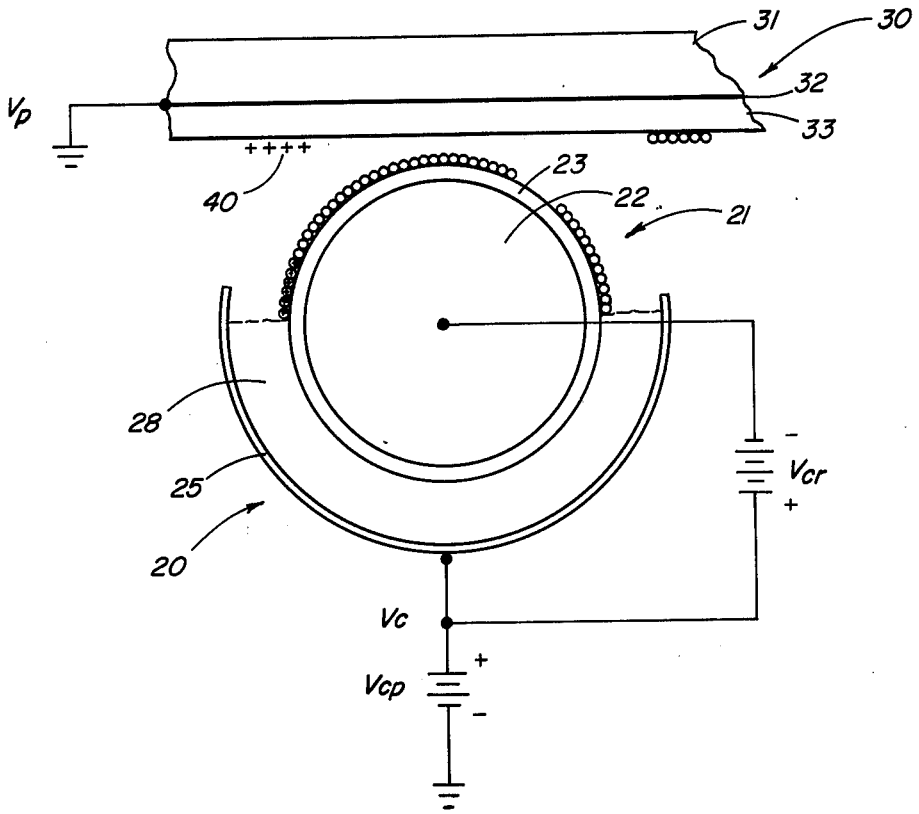
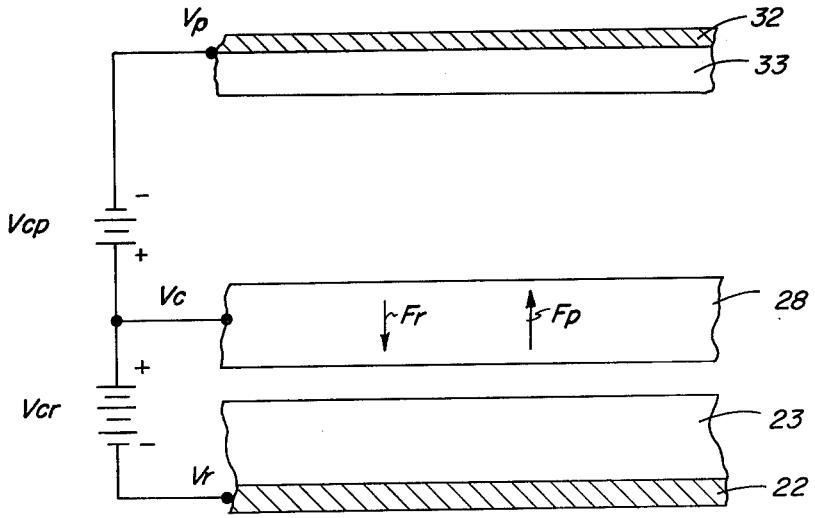
FIG. 2

ELECTROGRAPHIC DEVELOPMENT APPARATUS FOR USE WITH CONDUCTIVE TONER

BACKGROUND OF THE INVENTION

1. Field of the Invention

The present invention relates to the development of electrographic images and more particularly to apparatus for developing electrostatic images with single-component, conductive toner.

2. Brief Description of the Prior Art

It has been disclosed in the prior art that conductive toner particles, in contact with an electrostatic image-bearing member and provided with an electrical path to ground, will develop an induced charge, opposite to the image charge, and develop the electrostatic image (see, e.g., U.S. Pat. No. 3,166,432). One structural mode of implementing this development technique has been to feed such an image-bearing member into and through an electrically-grounded tray containing a supply of the conductive toner particles.

One problem which exists in such apparatus is that objectionable background toner deposits are caused by the intimate contact of the image member with toner in the bath. That is Van der Waals or other similar forces can cause toner deposition in uncharged areas, and electrostatic forces create similar problems in incompletely discharged areas. However, such prior art systems suffer an even more serious limitation in that no reliable control has been provided for establishing a threshold of development relative to the electrostatic images. Such a threshold is useful to control unwanted background depositions, but additionally, facilitates compensation for changes in system parameters, e.g., as might be presented by original document of differing background or image densities.

SUMMARY OF THE INVENTION

It is an object of the present invention to provide improved apparatus for developing electrographic images with single-component, conductive toners.

Another object of the present invention is to provide such apparatus which facilitates uniform application of such toner to the image member.

Another object of the present invention is to provide such apparatus with means enabling the establishment of a development threshold.

Still another object of the present invention is to provide such apparatus with means enabling selective image sense reversal.

The above and other objects and advantages are provided in accordance with the present invention by a conductive roller applicator having an outer dielectric surface layer and which is rotatable to bring conductive toner powder from a developer container to the image surface to be developed. Means are provided for electrically-biasing the roller and container relative to the photoconductor and its electrostatic image, so as to present to the image a uniform, substantially monolayer coating of powder which is controllably electrically retained on the roller. In a preferred embodiment of the invention, the potential level of the toner can be adjusted in conjunction with the attractive force between the toner and roller and in accordance with the electrostatic image to be developed, e.g., to allow development of either polarity image, to control image background development or to effect a reverse development of the image.

BRIEF DESCRIPTION OF THE DRAWINGS

The invention is hereinafter described in more detail with reference to the attached drawings which form a part thereof and in which:

FIG. 1 is a schematic side view of one embodiment of apparatus in accordance with the present invention;

FIG. 2 is a diagrammatic illustration of the relation of elements in FIG. 1.

DETAILED DESCRIPTION OF THE PREFERRED EMBODIMENTS

Figure 3:
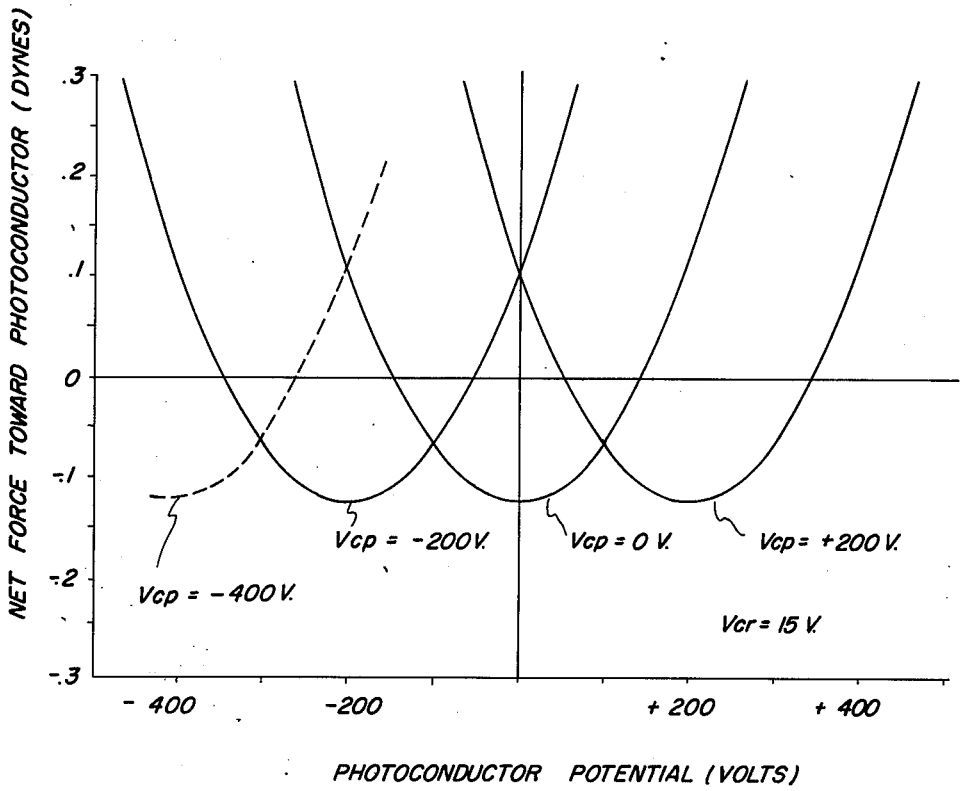
FIG. 3 is a graph showing the effect of changes in developer tray bias.

Referring to FIG. 1, one embodiment of development apparatus in accordance with the present invention is shown. The apparatus, designated generally 20, comprises a cylindrically-shaped applicator roller 21 which can include an electrically-conductive core 22, e.g., constructed of a metal such as aluminum, and an electrically-insulative surface layer 23, e.g., formed of a thin dielectric tape or as an anodized surface on the aluminum roller. The roller 21 is mounted for rotation in a developer trough 25 which also should be electrically-conductive, e.g., formed of metal. A supply of conductive toner particles 28 is provided in the trough in sufficient quantity to achieve a level contacting the roller 21.

A photoconductor 30 is mounted for movement past the development apparatus 20 so that successive portions of the photoconductor move in transfer relation with the upper surface portions of roller 21. The rate of movement of the photoconductor 30 and roller 21 preferably are synchronized so that no substantial relative velocity exists therebetween at the development interface. The photoconductor 30 can comprise a support 31 such as plastic film, a conductive layer 32 such as a thin metal coating and a photoconductive insulator layer 33 such as commonly used in electrophotography. In operation a latent electrostatic image 40 to be developed is formed on photoconductor 30 by uniformly electrostatically charging the photoconductor and then exposing it to a light image at stations upstream from the development station and not shown in FIG. 1.

Electrical means are provided for predeterminedly biasing the container and roller for development of an electrostatic image 40 on the photoconductor. Such biasing can be accomplished electrically by various circuits; however, in general it is desirable in accordance with the invention that a potential Vcr exist between the container 25 and the conductive portion 22 of roller 21 in sufficient magnitude to attract and retain toner. In accordance with a highly useful feature of the present invention it is desirable that a potential Vcp be provided between the container 25 and the conductive layer 32 of the photoconductor 30 to control deposition of the toner onto the photoconductor. In the illustrated embodiment, the potential Vp, of the conductive layer 32 is ground potential and the container is at a potential level Vc; therefore Vcp=Vc.

In operation, with the potential Vcr applied, the conductive toner in the container 25 is attracted to the surface of the roller 21 and is transported from the trough in a smooth continuous layer. Remarkably the toner's behavior on the surface of the roller 21 closely approximates a continuous conductor. Thus the toner at the development nip between the roller and the photoconductor is at a potential level substantially the same as container 25, i.e., Vc. The relation of the roller, toner and photoconductor is illustrated schematically in FIG. 2.

Considering the electrostatic forces acting on toner in the development region, with reference to FIG. 2, it will be appreciated that an electrostatic force Fr toward the roller will be proportional to the potential difference Vcr between the conductive portion of the roller and the toner. An additional electrostatic force Fp toward the photoconductor 33 will be proportional to the potential difference between the toner 28 and the electrostatic image on the photoconductor. If force Fp opposed force Fr with sufficient magnitude, the toner will be lifted off the roller and transported to the photoconductor. It is significant to note that, in accordance with the present invention, potential between the toner and electrostatic image can be selectively controlled by varying the voltage indicated as Vcp. In one useful mode, the voltage Vcr is determined to effect the minimum adhering force required to provide a uniform monolayer of toner on the applicator roller and the voltage Vcp is selected to provide a threshold for development.

It also should be noted that the forces Fr and Fp are dependent on the spacing between the toner and the roller or photoconductor. In FIG. 2, a small spacing is shown between the roller and toner to account for the fact that the toner particles are spherical and much electrostatic force is concentrated on toner surfaces above the insulator layer. However, as indicated in FIG. 2, the effective space between the toner and photoconductor is much greater than that between the toner and applicator so that a smaller potential difference is required for adhering the toner to the roller than for effecting transfer.

FIG. 3 illustrates how the force Fp theoretically varies with the electrostatic charge on the photoconductor for different voltages Vcp (in the illustrated embodiment Vcp=Vc since Vp is at ground). The model illustrated assumes a roller-toner voltage Vcr of 15 volts, a roller photoconductor gap of 0.25 mil, an insulator thickness of $8\times10^{-6}$ meters (dielectric constant=8), a photoconductor thickness of $10\times10^{-6}$ meters (dielectric constant=3) and a toner particle diameter of $40\times10^{-6}$ meters.

These curves represent the electrostatic forces calculated only on the basis of a simplified model. In reality it is expected that, due to statistical variations in dielectric and surface properties, the curves should be replaced by bands. It is of interest, however, to note where the curves cross the zero electrostatic force axis. This condition is a necessary, though not sufficient, condition for development.

For illustration, if the photoconductor had an image charge of −400 volts and a background charge of −200 volts, FIG. 3 suggests that operation with a container (i.e., toner) voltage Vcp (and Vc) of −200 volts would be a useful mode of operation for positive sense image development. That is, with respect to the background areas (−200 volts on the abscissa of FIG. 3), the net force is maximum toward the roller (i.e., a negative value on the ordinate); and with respect to image areas (−400 volts), the net force toward the photoconductor is well above the zero level.

Another important aspect of the present invention can be observed by reference to FIG. 3. If it is assumed that for the same electrostatic image (i.e., −400 image area and −200 background) the container were biased at −400 instead of −200 (i.e., Vcp=−400), the dotted-line curve in FIG. 3 represents the forces in effect. In such a mode it will be noted that, with respect to image areas of the photoconductor, the net force toward the roller is maximum while with respect to background areas the net force toward the photoconductor is well above the zero level. Thus development in a reverse image sense can be obtained by selective control of the container voltage.

Referring to FIG. 3 it can also be seen that the apparatus of the present invention can be readily used for development of an electrostatic image of either positive or negative polarity. For example if it were desired to develop an electrostatic image of +400 image area and +200 background charge, the apparatus could be usefully operated with a voltage Vcp of +200 volts (see the curve Vcp=+200 in FIG. 3).

Having explained above the general features of the present invention, the following more specific examples will afford further understanding of modes of its practice.

EXAMPLE I

In this example the development roller comprised an aluminum core having a thin dielectric tape on the surface. Carbon-coated polyamide toner having a resistivity of $10^{+3}$ to $10^{+4}$ ohm-cm and of about 40μ diameter was used. An organic photoconductor image member was charged to levels in the range of −500 to −1000 volts and contact exposed to an image pattern to produce a minimum background voltage. Upon contacting the image with roller bias of −50 volts and a photoconductor to roller spacing of about 0.001 inches to 0.003 inches image development was obtained.

EXAMPLE II

The same conditions existed in this example as in Example I except an aluminum roller having an anodized peripheral surface was used instead of the tape covered roller. This type of insulative layer was found to be superior to the Example I structure.

EXAMPLE III

In this example the Example II roller was used with a different organic photoconductor and the Example I toner and exposure technique. However image charge level was about −300 to −360 volts. The roller speed was varied from 11 to 92 rpm without adversely affecting image quality. In similar tests the roller voltage was varied from +20 to +70 volts, maintaining a constant roller to photoconductor gap and at higher voltages there was little image development.

It will be appreciated that a wide variety of materials are useful in accordance with the present invention. Spherical toners having a uniform size particle size distribution and low surface or bulk resistivity are desirable. Toners over the size range of about 10μ to 40μ have been particularly useful. Electrographic materials such as organic or inorganic photoconductors are useful as image elements. Also dielectric coated papers can be used. Further a dielectric film could be used if a reference electrode were provided opposite the developer applicator, i.e., behind the film.

In some embodiments it has been found useful to provide a development shield between the roller and image member to be developed. For example a slotted member comprising two conductive layers separated by a dielectric can be placed between the roller and image member with the side facing the image member biased to the same potential as the image area of the photoconductor and the side facing the roller at the roller bias potential. It has been found that such shielding prevents a "halo" effect in the developed image which can occur in some modes due to intense fringe fields.

The invention has been described in detail with particular reference to certain preferred embodiments thereof, but it will be understood that variations and modifications can be effected within the spirit and scope of the invention.

I claim:

1. In an electrographic device of the type in which an electrostatic imaging member having background and image portions is moved along an operative path for development, improved developing apparatus comprising:

(a) an applicator roller having an electrically-conductive central portion and an electrically-insulative peripheral surface, said roller being mounted for rotation to move successive portions of its surface to a transfer position in relation to the image bearing member;

(b) reservoir means for supplying electrically-conductive toner to the surface of said roller;

(c) means for establishing an electrical potential across the surface of said roller of sufficient magnitude to attract toner to said surface for movement therewith to said transfer position; and (d) means for maintaining the electrical potential of said toner at a level proximate the charge level of either said backgrond portion or said image portion of the imaging member to cause transfer of toner from the roller surface to the other said portion.

2. Apparatus for developing an electrostatic-image-bearing member, such member having first portions of electrical potential within a first potential-range and second portions of electrical potential within a second, lower potential-range, said apparatus comprising:

(a) applicator means having an electrically-conductive inner portion and an electrically-insulative outer surface and being mounted for movement such that said surface traverses an endless path which passes proximate said member;

(b) means, located along said path at a position spaced from said member, for supplying electrically-conductive toner particles at a location proximate said surface;

(c) means for electrically biasing said inner portion of said applicator means to attract toner to said outer surface with a first, threshold force; and (d) means for electrically biasing the toner on said surface at a predetermined potential such that the attractive force exerted by the electrostatic-image-bearing member on toner passing proximate thereto is: (1) less than said threshold force with respect to one of said first and second portions and (2) greater than said threshold force with respect to the other of said first and second portions.

3. In an electrographic device of the type utilizing an image member that bears a latent electrostatic image, which includes an image portion and a background portion differing significantly in electrical potential, improved image developing apparatus comprising:

(a) applicator means having an electrically-conductive central portion and an electrically-insulative peripheral surface, said applicator means being mounted for movement so that successive portions of said peripheral surface move sequentially into transfer relation with said image member;

(b) reservoir means, spaced from said image member, for supporting a supply of electrically-conductive toner in contact with a peripheral portion of said applicator means;

(c) means for electrically biasing said central portion of such applicator means at a first potential to establish, across said peripheral surface of said applicator means, an electrical field of magnitude sufficient to attract toner from said reservoir means and retain such toner on said peripheral surface during movement to transfer relation with said image member; and (d) means for electrically biasing the toner on said surface at a second potential which: (1) differs from said first potential so as to establish said electrical field; (2) is sufficiently equivalent to the potential of one of said image and background portions that the electrical attraction of such toner toward said peripheral surface exceeds the electrical attraction of such toner toward said one of said portions and (3) is sufficiently different from the potential of the other of said image and background portions that the electrical attraction of such toner toward said other of said portions exceeds the electrical attraction of such toner toward said peripheral surface.

* * * * *